United States Patent [19]

Tanaka et al.

[11] Patent Number: 4,759,860

[45] Date of Patent: Jul. 26, 1988

[54] TWO-CYCLE ENGINE OIL COMPOSITION

[75] Inventors: Tosimitu Tanaka, Kamifukuoka; Noboru Watanabe; Hiromiti Seiki, both of Ichihara, all of Japan

[73] Assignees: Honda Giken Kogyo Kabushiki Kaisha; Idemitsu Kosan Company Limited, both of Tokyo, Japan

[21] Appl. No.: 11,414

[22] Filed: Feb. 3, 1987

Related U.S. Application Data

[63] Continuation of Ser. No. 636,843, Aug. 1, 1984, abandoned.

[30] Foreign Application Priority Data

Aug. 18, 1983 [JP] Japan ..... 58-149608

[51] Int. Cl.[4] ..... C10M 137/04

[52] U.S. Cl. ..... 252/32.5; 252/52 R; 252/56 R; 585/1; 585/3

[58] Field of Search ..... 585/1, 3; 252/52 R, 252/32.5, 56 R

[56] References Cited

U.S. PATENT DOCUMENTS

| | | | |
|---|---|---|---|
| Re. 8,897 | 9/1866 | Lippincott | 252/52 R |
| 2,058,788 | 10/1936 | Hendrey | 252/52 R |
| 2,079,783 | 5/1937 | Wiezevich | 252/52 R |
| 2,898,299 | 8/1959 | Lowe | 252/52 R |
| 3,282,845 | 11/1966 | Anderson | 585/3 |
| 3,658,708 | 4/1972 | Ratto | 252/52 R |

*Primary Examiner*—Jacqueline V. Howard

*Attorney, Agent, or Firm*—Frishauf, Holtz, Goodman & Woodward

[57] ABSTRACT

A two-cycle engine oil composition which comprises a terpene compound selected from the group consisting of terpene hydrocarbons, terpene alcohols and terpene ether incorporated in a lubricant substance selected from the group consisting of a mineral oil, a polyglycol ester, a polyol ester, a phosphate, a dibasic acid ester, a polyolefin and a mixture thereof, the content of the terpene compound being in the range of 2 to 70% by weight based on the total amount of the composition. The two-cycle engine oil can reduce the concentration of smoke in the exhaust gas and provides an exhaust gas free of disagreeable and/or irritating odors which instead has a pleasant smell. The oil also has good detergent dispersing characteristics.

24 Claims, No Drawings

TWO-CYCLE ENGINE OIL COMPOSITION

This is a continuation of application Ser. No. 636,843, filed Aug. 1, 1984 and now abandoned.

BACKGROUND OF THE INVENTION

This invention relates to a two-cycle engine oil composition, and more specifically to a two-cycle engine oil composition permitting a reduction of the smoke concentration in the exhaust gas and removal of disagreeable or irritating odor to give pleasant or aromatic smell.

Two-cycle engines employed in motor cycles, chain saws and the like are operated by mixing gasoline as a fuel and two-cycle engine oil at prescribed proportions. The separate oiling (or lubricating) system has been dominantly adopted for the two-cycle engines in motor cycles and the like with a view toward achieving a reduction of the smoke concentration in the exhaust gas and an improvement in the cleaness of the exhaust gas. However, no satisfactory improvement has been reported with respect to two-cycle engine oils.

Two-cycle engine oil compositions are required to have such properties as (1) good detergency, (2) low smoke concentration in the exhaust gas, (3) exhaust gas free of disagreeable and/or irritating odors, (4) excellent anti-seizure property and the like.

Especially, the properties (2) and (3) have been attracting attention in recent years from the viewpoints of prevention of public pollution and protection of our living environments from contamination. Researches have been made with a view toward improving such properties, leading to some proposals on improved two-cycle engine oil compositions (see, Japanese Patent Publication Nos. 24521/1976; 24522/1976; 20467/1972; 34317/1982; etc.).

The above-proposed two-cycle engine oil compositions can certainly reduce the smoke concentration in the exhaust gas but cannot render the exhaust gas free of disagreeable oder. There is thus a standing demand for the development of an excellent two-cycle engine oil composition which is capable of reducing the smoke concentration and removing such disagreeable odor.

SUMMARY OF THE INVENTION

An object of the invention is to provide a two-cycle engine oil of a novel composition, which engine oil can reduce the smoke concentration in the exhaust gas, can make the exhaust gas free of disagreeable and/or irritating odors and instead rather scented with a pleasant smell, and further has good detergent dispersing property.

The two-cycle engine oil composition of this invention comprises a terpene type compound incorporated in a substance selected from the group consisting of a mineral oil, a synthetic oil, a polyolefin and a mixture thereof, the content of the terpene type compound being in the range of 2 to 70% by weight based on the total amount of the composition.

As a terpene type compound useful in the practice of this invention, may be mentioned one or more substances selected from terpene hydrocarbons represented by the molecular formula: $(C_5H_8)_n$ (wherein n means a positive integer) such as α-pinene, β-pinene, d-limonene, l-limonene, dipentene which is a 50:50 mixture of d-limonene and l-limonene, terpinolene, camphene, etc., or natural products containing these terpene hydrocarbons as their main components, such as mandarin oil (consisting primarily of d-limonene), lemon oil (also containing d-limonene as its principal component); terpene alcohols such as α-terpineol, β-terpineol, γ-terpineol, terpinen-1-ol and l-menthol, or natural products containing these terpene alcohols as their principal components, such as pine oil (consisting primarily of α-terpineol) and peppermint oil (containing l-menthol as its principal component); and terpene ethers such as 1,8-cineole, and natural products containing the terpene ethers as their main components, such as eucalyptus oil (consisting primarily of 1,8-cineole).

Among these terpene type compounds, d-limonene, α-terpineol, 1,8-cineole and the like each of which contains 10 carbon atoms per molecule are preferred owing to their excellent effectiveness and good availability.

It is essential to incorporate such a terpene type compound in an amount of 2 to 70% by weight. If it should be incorporated in any amounts less than 2% by weight, the resulting oil compositions will not bring about any substantial effects. On the other hands, any amounts in excess of 70% by weight will tend to reduce the anti-seizure property. The amount of such a terpene compound to be incorporated is preferably 5 to 50% by weight, and more preferably 10 to 40% by weight.

The second component in which the terpene type compound according to the present invention is not particularly limited, so long as it is compatible with the terpene type compound and the resulting oil composition incorporated with the terpene type compound has an excellent effect brought about by the present invention.

However, as the second component, there may preferably be employed a mineral oil, a synthetic oil, a polyolefin or a mixture thereof. It should however be borne in mind that the term "synthetic oil" as used herein embraces synthetic oils other than polyolefins.

As the mineral oil to be used in the present invention, there may be mentioned, for example, neutral oil such as 70 NEUTRAL, 100 NEUTRAL, 150 NEUTRAL, 300 NEUTRAL, 500 NEUTRAL and BS(BRIGHT-STOCK) which are all obtained by solvent refining or hydrogenation refining.

As the synthetic oil, there may be mentioned, for example, polyglycol esters, polyol-esters, phosphates, silicone oil, alkyl diphenyl and dibasic acid esters.

No specific limitation is imposed on the types of the mineral oil and/or synthetic oil. It is however preferred to use those having kinematic viscosities at 100° C. within the range of from 2 to 5 centistoke (cSt). It is also preferred that such a mineral oil and/or synthetic oil amount to 50% by weight or less. Any amounts exceeding 50% by weight will lead to undesirable outcomes such a increased smoke concentrations and impaired detergency. The most preferred amount of such a mineral oil and/or synthetic oil may range from 10 to 40% by weight.

As exemplary polyolefins, may be mentioned polybutene, polypentene, polyhexene, polyheptene, polyoctene, polydecene and the like with polybutene being most preferred. If the molecular weight of a polyolefin to be employed is be too small, the resulting oil composition will have poor anti-seizure property. On the other hand, an excessively-large molecular weight will limit its amount to be incorporated and will hence cut down its smoke-reducing effect. The weight average molecular weight of such a polyolefin may generally be within the range of 250 to 200,000, or may preferably be within the range of 300 to 5,000. Its amount may range from 5 to 98% by weight, with the range of 10 to 50% by weight being preferred. Any amounts less than 5% by weight will fail to bring about the smoke-reducing effect to any significant extent.

The two-cycle engine oil composition of this invention may be readily prepared by mixing the above-described various components at prescribed proportions.

It may also be feasible, whenever necessary, to incorporate in the oil composition of this invention a detergent dispersant such as the sulfonate, phenate or phosphonate of calcium, barium or magnesium or an alkenylsuccinic imide, an extreme pressure additive such as a dialkyldithiophosphoric acid salt or phosphoric acid ester, a defoaming agent such a polyacrylate or silicone oil, kerosine and/or isooctane at suitable proportions. The two-cycle engine oil composition of this invention may be applied to both separate oiling engines and mixed oiling engines.

The present invention will be illustrated by referring to the following Examples 1 to 11 and Comparative Examples.

Various components given in the below-described Tables 1 and 2 were mixed together at proportions, which are also shown in each Table, to prepare a variety of two-cycle engine oil compositions. Two-cycle engines were operated using such oil compositions so as to determine their detergency, the smoke concentrations in exhaust gases and the smells of the exhaust gases in accordance with the below-described testing methods, whereby to evaluate the oil compositions.

Detergent dispersing property

Evaluation was made following the panel coking method prescribed in accordance with Federal Test Method 791B.3462. In the above testing method, a two-cycle engine was operated for 3 hours on a cycle, which consisted of 15 seconds splash and 45 seconds non-splash, under such conditions as 300° C. panel temperature and 120° C. oil temperature. Each oil composition was evaluated based on the weight (mg) of deposited carbon.

Smoke concentration in the exhaust gas

Measured by means of a smoke meter (manufactured by Takaishi Denki K.K.; Model: USPHS SAE 2255) was the smoke concentration in the exhaust gas evolved through the exhaust pipe when a two-cycle gasoline engine (50 cc; separate oiling type) had been accelerated from an engine-idling state (1700 to 1800 rpm) to the full throttle valve-opening state. The scale is based on 0=100% transmission, 100=0% transmission. Accordingly, smaller values indicate lower smoke concentrations.

Smell of the exhaust gas

The exhaust gas was smelled at a location 1 m apart from the exhaust pipe, while operating a two-cycle gasoline engine (50 cc; separate oiling type) in an idling state.

Results of the above tests are summarized in the following Tables 1 and 2, in which the amount of each detergent dispersant is expressed in terms of parts by weight supposing the corresponding total weight of the mineral oil, polybutene, terpene type compound and kerosine be 100 parts by weight.

TABLE 1

| | Example No. of the present invention | | | | | | | | | | |
|---|---|---|---|---|---|---|---|---|---|---|---|
| | 1 | 2 | 3 | 4 | 5 | 6 | 7 | 8 | 9 | 10 | 11 |
| Composition: | | | | | | | | | | | |
| Mineral oil | | | | | | | | | | | |
| Mineral oil A*1 | 40 | 20 | — | — | — | 30 | 20 | — | — | — | — |
| Mineral oil B*2 | 40 | 50 | 60 | — | — | — | — | — | — | — | — |
| Synthetic oil | | | | | | | | | | | |
| Synthetic oil A*3 | — | — | — | — | — | — | — | — | — | 30 | — |
| Synthetic oil B*4 | — | — | — | — | — | — | — | — | — | 30 | |
| Polybutene | | | | | | | | | | | |
| Polybutene A*5 | — | — | — | 40 | — | 40 | 45 | — | — | 40 | 30 |
| Polybutene B*6 | — | — | — | 40 | — | — | — | 40 | 40 | — | — |
| Polybutene C*7 | — | — | — | — | 30 | — | — | — | — | — | — |
| Terpene compound | | | | | | | | | | | |
| d-Limonene*8 | 20 | 30 | 40 | 20 | 70 | 30 | 10 | — | — | 30 | — |
| 1,8-Cineole*9 | — | — | — | — | — | — | — | 40 | — | — | — |
| α-Terpineol*10 | — | — | — | — | — | — | — | — | 40 | — | — |
| α-pinene*11 | — | — | — | — | — | — | — | — | — | — | 40 |
| Other additives | | | | | | | | | | | |
| Kerosine | — | — | — | — | — | — | 25 | 20 | 20 | — | — |
| Detergent dispersant*12 | 5 | 5 | 5 | 5 | 5 | 10 | 10 | 5 | 5 | 5 | 5 |
| Results: | | | | | | | | | | | |
| Detergent dispersing property (mg) | 22 | 29 | 38 | 8 | 7 | 25 | 17 | 17 | 19 | 9 | 10 |
| Smoke concentration (%) | 70 | 50 | 90 | 6 | 4 | 12 | 10 | 9 | 8 | 15 | 16 |
| Smell of the exhaust gas | ← Mandarin smell → | | | | | | | | | | |

TABLE 2

| | Comparative Example No. | | | | | |
|---|---|---|---|---|---|---|
| | 1 | 2 | 3 | 4 | 5 | 6 |
| Composition: | | | | | | |
| Mineral oil | | | | | | |
| Mineral oil A*1 | — | — | 30 | 20 | 100 | 40 |
| Mineral oil B*2 | — | 20 | 30 | — | — | 40 |
| Synthetic oil | | | | | | |
| Synthetic oil A*3 | — | — | — | — | — | — |
| Synthetic oil B*4 | — | — | — | — | — | — |
| Polybutene | | | | | | |
| Polybutene A*5 | 40 | 60 | — | 30 | — | — |
| Polybutene B*6 | 40 | 20 | 40 | — | — | — |
| Polybutene C*7 | — | — | — | 20 | — | — |
| Terpene compound | | | | | | |
| d-Limonene*8 | — | — | — | — | — | — |
| 1,8-Cineole*9 | — | — | — | — | — | — |
| α-Terpineol*10 | — | — | — | — | — | — |
| α-Pinene*11 | — | — | — | — | — | — |
| Other additives | | | | | | |
| Kerosine | 20 | — | — | 30 | — | 20 |
| Detergent Dispersant*12 | 5 | 5 | 5 | 5 | 5 | 5 |
| Results: | | | | | | |
| Detergent dispersing property (mg) | 15 | 83 | 50 | 31 | 130 | 40 |
| Smoke concentration (%) | 10 | 62 | 19 | 13 | 73 | 80 |
| Smell of the | ← Disagreeable odor (irritating smell) → | | | | | |

TABLE 2-continued

| | Comparative Example No. | | | | | |
|---|---|---|---|---|---|---|
| | 1 | 2 | 3 | 4 | 5 | 6 |
| exhaust gas | | | | | | |

In Tables 1 and 2:

*1: Product of Idemitsu Kosan K. K.; "150 NEUTRAL"

*2: Product of Idemitsu Kosan K. K.; "BRIGHTSTOCK"

*3: Product of Nippon Oil & Fats Co., Ltd.; "Unister H310R"

*4: Product of Nippon Oil & Fats Co., Ltd.; "Unister H312R"

*5: Product of Idemitsu Seikiyu Kagaku K. K.; "IDEMITSU POLYBUTENE OR" (molecular weight: 370)

*6: Product of Idemitsu Sekiyu Kagaku K. K.; "IDEMITSU POLYBUTENE 100R" (molecular weight: 920)

*7: Product of ESSO Corp. (molecular weight: 80,000)

*8: Product of Yasuhara Yushi K. K.; "d-LIMONENE N"

*9: Product of Yasuhara Yushi K. K.: "CIONELE D"

*10: Product of Yasuhara Yushi K. K.,; "TERPINEOL"

*11: Product of Yasuhara Yushi K. K.,; "α-PINENE"

*12: Mixture of polybutenylsuccinic imide having a molecular weight of 1000 and calcium sulfonate (Weight ratio 4:1)

As apparent from the results given in the above Table, use of an oil composition according to this invention will reduce the smoke concentration in the exhaust gas, will make the exhaust gas have a pleasant smell, and will provide good detergency. A synergistic effect will be brought about when polybutene and a terpene compound are incorporated in combination, whereby providing an oil composition having still better properties.

Therefore, the oil compositions of this invention are useful as two-cycle engine oil compositions.

What is claimed is:

1. A two-cycle engine oil composition which comprises a terpene compound selected from the group consisting of terpene hydrocarbons, terpene alcohols and terpene ether incorporated in a lubricant substance selected from the group consisting of a mineral oil, a polyglycol ester, a polyol ester, a phosphate, a dibasic acid ester, a polyolefin and a mixture thereof, the content of the terpene compound being in the range of 2 to 70% by weight based on the total amount of the composition.

2. The two-cycle engine oil composition according to claim 1, wherein when said lubricant substance comprises at least one of the mineral oil and the synthetic oil, it is in the range of 0 to 50% by weight, and when it comprises the polyolefin it is in the range of 5 to 98% by weight.

3. The two-cycle engine oil composition according to claim 1, wherein the content of the terpene compound is in the range of 5 to 50% by weight.

4. The two-cycle engine oil composition according to claim 2, wherein the content of the terpene compound is in the range of 10 to 40% by weight.

5. The two-cycle engine oil composition according to claim 1, wherein the terpene hydrocarbons are α-pinene, β-pinene, d-limonene, l-limonene or dipentene; the terpene alcohols are α-terpineol, β-terpineol, γ-terpineol, terpinen-1-ol or l-menthol; the natural products containing the terpene; the terpene ether is 1,8-cineole.

6. The two-cycle engine oil composition according to claim 2, wherein said terpene hydrocarbon is d-limonene.

7. The two-cycle engine oil composition according to claim 2, wherein said terpene alcohol is α-terpineol.

8. The two-cycle engine oil composition according to claim 2, wherein said terpene ethers is 1,8-cineole.

9. The two-cycle engine oil composition according to claim 1, wherein said lubricant substance comprises at least one of the mineral oil and the synthetic oil and has a kinematic viscosity of 2 to 50 cSt at 100° C.

10. The two-cycle engine oil composition according to claim 2, wherein said lubricant substance comprises at least one of the mineral oil and the synthetic oil and has a kinematic viscosity of 2 to 50 cSt at 100° C.

11. The two-cycle engine oil composition according to claim 3, wherein the mineral oil and/or the synthetic oil have/has a kinematic viscosity of 2 to 50 cSt at 100° C.

12. The two-cycle engine oil composition according to claim 1, wherein said lubricant substance is the polyolefin which has a molecular weight of 300 to 5,000.

13. The two-cycle engine oil composition according to claim 2, wherein said lubricant substance is the polyolefin which has a molecular weight of 300 to 5,000.

14. The two-cycle engine oil composition according to claim 3, wherein the polyolefin has a molecular weight of 300 to 5,000.

15. The two-cycle engine oil composition according to claim 2, wherein said lubricant substance is the content of the mineral oil and/or the synthetic oil is in the range of 10 to 40% by weight and the content of the polyolefin which is in the range of 10 to 50% by weight.

16. The two-cycle engine oil composition according to claim 3, wherein the molecular weight of said polyolefin is 300 to 5,000.

17. The two-cycle engine oil composition according to claim 1, said polyolefin is polybutene.

18. The two-cycle engine oil composition according to claim 2, wherein said polyolefin is polybutene.

19. The two-cycle engine oil composition according to claim 3, wherein said polyolefin is polybutene.

20. The two-cycle engine oil composition according to claim 19 wherein said terpene compound is in an amount of from 10 to 40% by weight and wherein said polybutene is in an amount of from 10 to 50% by weight.

21. The two-cycle engine oil composition according to claim 20, wherein said terpene hydrocarbon is d-limonene.

22. The two-cycle engine oil composition according to claim 20, wherein said terpene alcohol is α-terpineol.

23. The two-cycle engine oil composition according to claim 20, wherein said terpene ethers is 1,8-cineole.

24. The two-cycle engine oil composition according to claim 5, wherein the terpene compound is in an amount of 10 to 40% by weight and wherein said lubricant substance comprises at least one of the mineral oil and the synthetic oil and wherein said mineral oil and synthetic oil have a kinematic viscosity of 2 to 50 cSt at 100° C.

* * * * *